US005327693A

United States Patent [19]

Schmid

[11] Patent Number: 5,327,693

[45] Date of Patent: Jul. 12, 1994

[54] SEALING DEVICE FOR CONCRETE JOINTS AND PROCESS FOR THE INTRODUCING OF A SEALING MEDIUM INTO SEALING DEVICES

[76] Inventor: René P. Schmid, Grundstrasse 2, CH-8165 Oberweningen, Switzerland

[21] Appl. No.: 85,837

[22] Filed: Jul. 6, 1993

Related U.S. Application Data

[62] Division of Ser. No. 578,830, Sep. 5, 1990, Pat. No. 5,249,401.

[30] Foreign Application Priority Data

Sep. 8, 1989 [DE] Fed. Rep. of Germany ... 8910744[U]

[51] Int. Cl.[5] ..... E04F 21/165

[52] U.S. Cl. ..... 52/396.02; 52/309.6; 52/250; 404/47

[58] Field of Search ..... 52/396, 576, 577, 309.4, 52/309.5, 309.6, 250, 169.3; 404/47, 49, 69, 107

[56] References Cited

U.S. PATENT DOCUMENTS

| | | | |
|---|---|---|---|
| 1,691,402 | 11/1928 | Oden | 52/396 X |
| 1,716,994 | 6/1929 | Wehrle | 52/396 X |
| 2,277,286 | 3/1942 | Bechtner | 52/396 X |
| 3,111,069 | 11/1963 | Farbish | 52/396 X |
| 3,629,986 | 12/1971 | Klittich | 52/396 |
| 4,486,994 | 12/1984 | Fisher et al. | 52/309.4 |

FOREIGN PATENT DOCUMENTS

| | | | |
|---|---|---|---|
| 2332373 | 6/1977 | France | 52/309.6 |

*Primary Examiner*—Carl D. Friedman
*Assistant Examiner*—Robert J. Canfield
*Attorney, Agent, or Firm*—Goodman & Teitelbaum

[57] ABSTRACT

A sealing device for sealing a joint disposed between two concreting sections, having an impermeable profile preferably fabricated from a synthetic material and constructed in a hood form to be open in cross section. The profile is mounted with the free longitudinal edges of its side portions adjacent to a concrete surface, so that a flow channel is formed therein for receiving a sealing medium between the profile and the concrete surface, where the sealing medium can emerge from between the free longitudinal edges of the profile and the concrete surface. A further sealing device is a body fabricated from a foam material or a foam material band, having a rectangular cross section provided with passage pores, the body being mounted to rest on the concrete surface, so that the flow channel for receiving the sealing medium is formed by the body itself, where the sealing medium emerges from the passage pores into the joint area. In a process for introducing the sealing medium into the sealing device, after establishing the second concreting section, a connection is provided between the outside portion of the concrete and the sealing device by preferably drilling a bore, through which the sealing medium is introduced into the interior of the sealing device.

20 Claims, 16 Drawing Sheets

Fig. 20
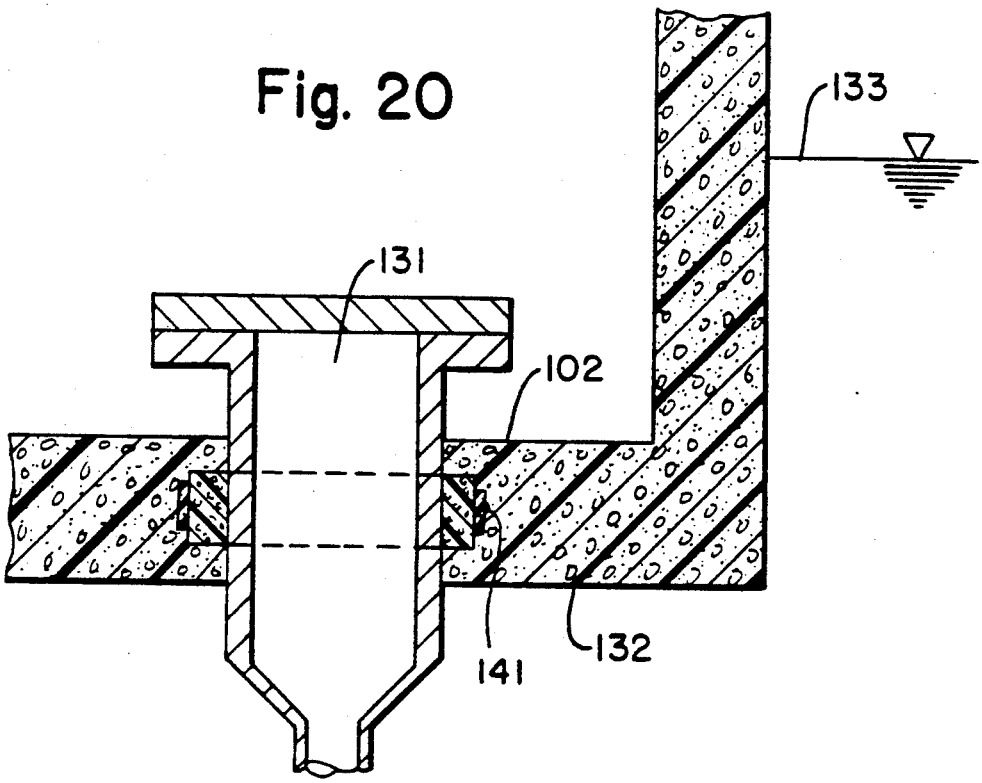
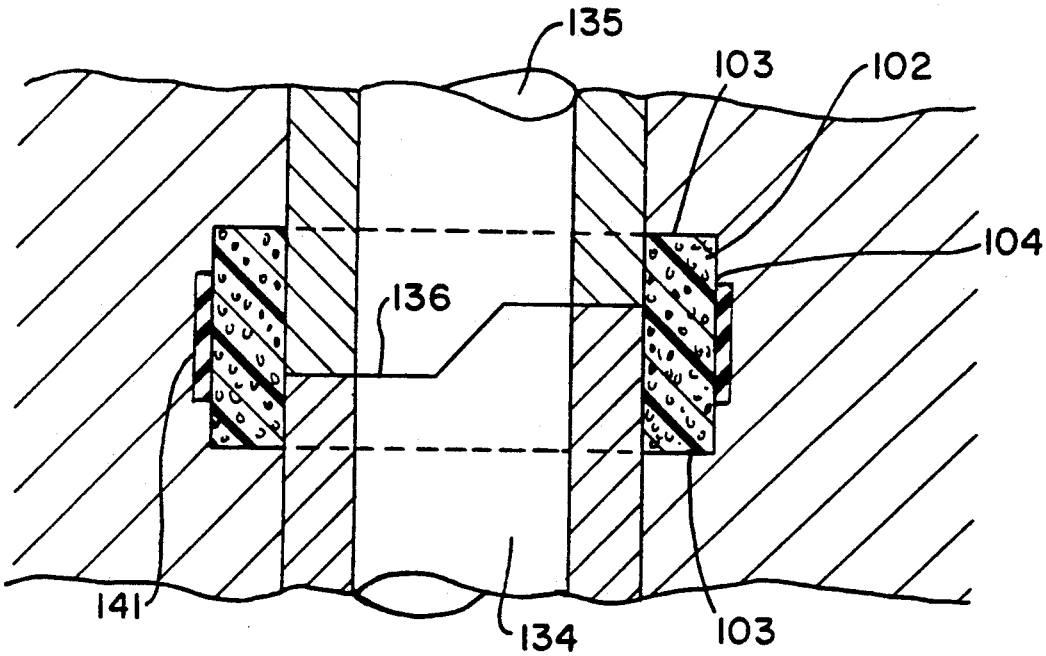
Fig. 21

SEALING DEVICE FOR CONCRETE JOINTS AND PROCESS FOR THE INTRODUCING OF A SEALING MEDIUM INTO SEALING DEVICES

CROSS-REFERENCE TO RELATED APPLICATION

This is a division of co-pending application Ser. No. 07/578,830, filed Sep. 5, 1990 now U.S. Pat. No. 5,249,401.

BACKGROUND OF THE INVENTION

The invention relates to a sealing device for concrete joints, as well as to a process for introducing a sealing medium into sealing devices.

Swiss patent CH-PS 600,077 discloses a sealing device in the form of a porous tube. This tube consists of a supporting body in the form of a coil spring, that is surrounded by a first braided tube, which, in turn, is surrounded by an outer, net-type, porous tube. After the mounting of this sealing device and the concreting of the second concreting section, a sealing medium is pressed into the hose-type sealing device, which is to emerge into the faulty places of the concrete.

In this known sealing device, it is disadvantageous that the laying is complicated, and that the laid tubes, in the concreting process, can be displaced or crushed and/or tear. Further, the porous tube material can be clogged by concrete slurries, so that an emergence of the sealing medium is no longer possible. Moreover, the production costs of such tubes are expensive.

The sealing device according to W. German utility model DE-GM 83 35 231 endeavors to obviate the disadvantage of the clogging of the tube body, by providing a non-woven material between the supporting body, in the form of a coil spring, and the outer net-type tube, the non-woven material being permeable to liquid, but being impermeable to fine concrete particles.

The disadvantage of the clogging of the net-type tube can be obviated possibly by the arrangement of the non-woven material, but there still remains the above described disadvantages with respect to the use of a tubular sealing device.

Finally, W. German utility model 86 08 396 discloses a further sealing device in the form of an injection tube, which, on the one hand, is supposed to obviate the disadvantage of the positioning of the tube by lashings provided on the tube body and, on the other hand, provides a desired breaking place in the longitudinal direction of the tubular body through which the sealing medium is to emerge into the concrete. The fundamental advantages of the injection tube, however, are yet to be proved.

Also with this known sealing device, there continues to persist the drawbacks of the crushing and/or tearing of the injection tube, and also the disadvantage that the laying of the injection tube is extremely laborious. Furthermore, the costs of such injection tubes is expensive.

All known sealing devices have in common the feature that the sealing medium is pressed directly into the tube beginning or the tube end. The tube beginning and also the tube end must be freely accessible from the outside after the conclusion of the concreting process.

This type of introduction of the sealing medium has, on the one hand, the disadvantage that the concrete sheathing must include recesses for the tube ends, whereby the sheathing operations are increased. Further, on the other hand, it can happen in the sheathing-in or concreting that the tube ends are damaged, whereby a penetration of the sealing medium is rendered difficult or is possible only with expensive additional measures.

SUMMARY OF THE INVENTION

The object of the present invention is to provide a sealing device in which a secure positioning of the sealing device is possible, a destruction or damaging of the same is prevented, and an economical simply installed sealing device is created, with which there is assured a dependable sealing of joints, especially concrete joints.

Further, there is to be provided a process with which the sealing medium can be introduced surely, economically, and in a simple manner into sealing devices, especially of the proposed type.

In respect to the apparatus, an object is to provide a sealing device according to the features of the present invention as set forth below.

The proposed sealing device is completely detached from the previous use of the known tubular sealing devices, and proposes use of a hood-shaped profile open in cross section. The profile is mounted with the free longitudinal edges of its side portions or side walls resting on the concrete surface, so that a free passage or flow channel is formed between the profile and the concrete surface, in which arrangement the sealing medium can emerge from between the free longitudinal edges of the profile and the concrete surface into the joint area. Such profiles can be produced—depending on material in the injection process or extrusion process—rapidly and economically and can be positioned in a simple manner.

As a sealing medium, there can be used, for example, silicates or a hardening mono-component or a multi-component synthetic material in a fluid consistency. Also a synthetic resin, especially a 2-component acrylic resin, is used as the sealing medium.

Advantageously the profile, as seen in cross section, is a U-shaped profile with a cover wall and two side walls extending vertically therefrom, with a preferred cross section width of 30 mm and a preferred cross section height of 20 mm.

The stackability of the profiles in storage can be improved by providing the profiles with a trapezoidal or arcuate cross section.

An advantageous fastening of the profile is provided by one or more screws, pins or nails gripping through this profile, transversely to the longitudinal axis of the profile, and also gripping into the concrete.

The fastening of the profiles can preferably be improved by the screw or the nail being supported by its head, preferably resting on a washer disposed on the cover portion or the cover wall of the profile, with the shaft of the screw or nail extending through a hole in the cover wall and engaging into the concrete surface, possibly into a dowel installed therein.

A rapid mounting of the profile is advantageously possible by the shooting-in of a pin or of a nail.

A supporting of the cover wall is made possible by a clamping of the cover wall between the head and the shaft of the screw, pin or nail. The clamping-in occurs preferably with a counter nut on the screw, pin or nail.

Another advantageous type of support of the cover wall occurs with a spacer which is arranged between the concrete surface and the inner surface of the cover wall.

The emergence of the sealing medium is facilitated by the material of the side walls being more flexible in comparison to the material of the cover wall.

Advantageously, sealing lips can be molded on the longitudinal edges, preferably in one piece, which likewise facilitate the emergence of the sealing medium.

The sealing lips are preferably elastic, in particular, being made of soft plastic or rubber or the like, which likewise facilitates the emergence of the sealing medium.

Advantageously, on the longitudinal edges of the profile, as seen in cross section, there are provided horizontally running flanges extending away from the profile, with a foam substance band being arranged on the flange surfaces facing the concrete surface. The uprighting(s) of the profile over the flanges provided with the foam material band, on the one hand, provide for an improved resting of the profiles on the concrete surface and, on the other hand, provide for an increased emergence of the sealing medium along the longitudinal edges of the profile. The emergence of the sealing medium is made possible by the porous properties of the foam material band. Moreover, the profiles can also be fastened in the flange surface portion, by suitable holding means, onto the concrete surface.

In an advantageous manner, it is provided that the interior of the profile is filled with a plastic form having open passage pores, in which arrangement, the sealing medium can be conducted through the flow channel by the passage pores of the plastic foam. The plastic foam additionally supports the cross section form of the profile, and provides that the consumption of the sealing medium used is substantially reduced. The plastic foam is chosen in such a way that it has sufficiently many and sufficiently large passage pores so as to not to hamper the entry of the sealing medium and not even to prevent it.

Preferably, the interior of the profile can also be foamed filled with synthetic foam, or a synthetic foam strip can be fitted into the interior. On these proposed types, the interior can be rapidly and economically filled with the plastic foam.

Advantageously, the plastic form or the plastic foam strip includes a projecting length beyond the longitudinal edges of the profiles. This projecting length provides for an increased emergence cross section for the sealing medium to emerge from the profile.

Preferably, there is provided, in a longitudinal direction of the profile underneath the cover wall, a free passage channel with a bottom wall arranged about in the middle of the height of the side walls. The bottom wall has a longitudinal slit or similar passages. The flow channel underneath the bottom wall is filled with the plastic foam. Through this formation of the profile, there is formed a free passage channel into which the sealing medium can first enter unimpeded and can distribute itself, in order then to emerge through the longitudinal section into the plastic foam, and from there into the joint area.

The passage channel can preferably also be formed by other means. In the inner surface of the profile facing the flow channel, preferably in the inner surface of the cover wall, there is provided a groove running in a longitudinal direction of the profile. In this alternative formation, the above-mentioned advantages are yielded in a like manner.

Preferably, for the joining of at least two profiles, there are provided, between the abutting edges of the profiles, connecting elements having the same cross section form as the profiles, preferably likewise of synthetic material. With the aid of such connecting elements, the profiles can be arranged in arbitrary directions on the concrete surface.

Preferably, the connecting elements can be straight connecting pieces, flat corner angles, upright corner angles, T-pieces or crossing pieces. With the aid of the proposed connecting elements, there can be provided the most substantial direction changes in the laying of the profiles.

Advantageously, the connecting elements are slippable onto the profile and are held thereon in a fixed form by a force fit. The connection of the individual profiles by the connecting elements is provided, accordingly, in a simple manner, where the proposed connection provides that no sealing medium can escape from the profiles in the abutting area.

In an advantageous manner, the connecting elements are screwable together with the profiles onto the concrete surface. Accordingly on the abutment place, there only has to be used one support for the profile and the connecting element.

In order to assure that the sealing medium escapes neither from the profiles nor from the connecting element at the abutment thereof, it is advantageous that for connecting the profiles to one another or for connecting the profiles with the connecting elements, an impermeable adhesive band is provided at the abutting places. The adhesive band can be applied preferably in such a way that only the surface of the abutting place is covered. In this arrangement, the adhesive band can also bend before the closing-off of the free longitudinal edges, since the adhesive band, on the one hand, is to prevent a slipping of the profiles and, on the other hand, is to prevent an escape of the sealing medium from the cover wall portion and the upper side-wall portion of the profiles, whereas an increased emergence in the lower portion of the side walls can be altogether desired. The abutting places can preferably also be welded.

Advantageously, the profile or the connecting elements include a connection for the injection of the sealing medium, especially in the form of a tube or of a nonporous flexible tube, which is arranged with its free end outside of the joint area or outside of a sheathing. It is possible, accordingly, to already provide certain elements of the sealing device with such a connection, so that it is no longer necessary to create such a connection place in situ. To especial advantage, however, the later described process can be used for the introduction of the sealing medium according to the invention.

In order to make possible deformations of the sealing device about its longitudinal axis, and in order to make it possible to fit curved concrete surfaces, it is advantageous that the profiles or connecting elements are provided with notches in the side walls. The corners or notch apexes of the notches end on the cover wall or are shortly spaced before the cover wall.

In an advantageous form of the invention, the profiles or connecting elements are bent about their longitudinal axis and fastened to a curved concrete surface, or to an arcuate or circular body, for example a pipe. In which case, the side edges of the notches abut against one another so that the notches are thus closed when the longitudinal edges of the side wall rest on the concrete surface or on the body. With the aid of this form, the sealing device can be arranged not only on curved concrete surfaces, but even on arcuate or circular bodies. What is important, is that in the engaging of the longitudinal edges on the concrete surface or on the surface of the corresponding body, the notches (or grooves) are completely closed. The notches can be additionally sealed off with an adhesive band.

An advantageous fastening of the profile is provided by the profile and/or a connecting element being held by a pipe-clip shaped yoke.

The fastening, for example to a reinforcing rod, is preferably provided by the yoke including, on the free end of its holding arm extending about parallel or slightly inclined to the concrete surface, a plugging device for the plugging-on, for example, to a reinforcing rod.

In a special form, the plugging device is formed by a bending of the holding arm through about 360 degrees extending obliquely, preferably to the side away from the profile to be held by the supporting arm thus formed. In this case, the diameter of bending and the distance of the starting portion from the end portion of the bend is greater than the diameter of the reinforcing rod. The proposed holding arrangement can thus be positioned securely and undisplaceably in a simple manner.

The spring yoke is preferably of elastically bendable material, especially spring steel, in order to make it possible to compensate for possible tolerances.

Preferably, the yoke is bent from round wire, which can be brought correspondingly easily and simply into the desired form.

A further apparatus object is to provide a sealing device according to the characterizing features of the present invention as set forth below.

The sealing device consists of a body preferably rectangular in cross section, of a foam material or a foam band having passage pores, which is placed on the concrete surface and mounted so that the passage or passage channel is formed by the body itself, and so that the sealing medium emerges from the passage pores into the joint area.

The body, as seen in cross section, can also have other forms, for example, a trapezoidal form, or a bent or circular-segmental form. By the fact that the sealing medium emerges into the joint area not only in the area of the upright surface of the foam material band, but also from its side and cover portions, there is achieved a high degree of sealing in the area of the concrete joint. An entry opening for the sealing medium can be provided, for example, a tubular hollow body which is used with one end inserted into the body, and is arranged with the other end outside the second concreting section or outside its sheathing. To especial advantage, however, the later-described process according to the invention can be used for the introduction of the sealing medium.

It is understood, that the foam substance used or the foam substance band, on the one hand, provides sufficient porosity for the passage of the sealing medium and, on the other hand, is of a consistency that avoids the compressing of the foam substance or of the foam substance band by the applied concrete. Also a synthetic resin, especially a 2-component acrylic resin, is used as a sealing medium.

The fastening of the body to the concrete surface is provided advantageously by one or more pins, screws or nails engaged transversely to the longitudinal axis of the body and gripping into the concrete. By the introduction of dowels into the concrete surface, or by a predetermined adjustment of the injecting apparatus, it is assured that the aforementioned holding means will engage only so far into the concrete surface in order for their head portions to lie in a plane with the surface of the body after the introduction thereof.

The desired end position of the pins, screws or nails can be achieved by the use of tubular spacers in the body which grip around the holding means, in which arrangement the length of the spacers corresponds about to the cross section height of the body. The spacer, by engaging the head portions, provides that the holding means do not penetrate too deeply through the body.

Another preferred support of the body can also be provided by supporting profiles embracing it, which are mounted on the concrete surface. The support profiles, which can be metal or plastic bands, grip wholly or partly about the cross section circumference of the body. In this arrangement, the support profiles are disposed with one free end on the concrete surface, so that the supporting arrangement holds fast or clamps the body to the concrete surface, without, however, substantially reducing the cross section of the body at the holding place.

In order to facilitate the passage or through-flow of the sealing medium, in the cross section interior of the body there can be provided a continuous recess running in a longitudinal direction, which serves as a passage channel for the sealing medium. In the introduction of the sealing medium, the passage channel is first filled, and thereupon the sealing medium penetrates the body until it emerges into the concrete portion, thus closing the joints present.

The connecting of at least two bodies at the abutting edges thereof is provided advantageously by connecting elements having the same cross section form and consisting of the same material as the bodies.

These connecting elements can be straight connecting pieces, flat corner angles, upright-edge corner angles, T-pieces or crossing pieces, so that direction changes can be taken into account without any problems in the laying of the bodies.

Preferably, an adhesive band is provided at the abutting places for the joining of the bodies with one another, or for the joining of the bodies with the connecting elements. The adhesive band serves principally for securing the position of the bodies on the concrete surface, and preferably need only be applied on the side of the body away from the concrete surface, on the upper portions of the side parties of the bodies, so that at the abutting place, in spite of the adhesive band, sufficient sealing material can emerge.

For adaptation to curved concrete surfaces, or bent or circular elements, it is advantageously provided that transversely to the longitudinal axis of the bodies or of the connecting elements, there are provided V-shaped, notch-type incisions arranged adjacently to each other in the longitudinal axial direction, extending across the entire cross sectional width. The notch apexes are arranged somewhat below the cross sectional height of the bodies or the connecting elements. The notch type incisions, therefore, extend in height only so far as to permit the body to still form a cohesive body.

Preferably, the bodies or connecting elements are bent about their longitudinal axis and fastened to a curved concrete surface, or to an arcuate or circular element, for example a pipe. In this system, the side edge surfaces of the notches abut against one another so that the notches are thus closed when the underside of the body lies on the concrete surface or on the element. In this manner, the foam material bands can also follow the curved or bent courses.

In an advantageous manner, the bodies and/or the connecting elements are held on the circular element by an endless rubber band, the rubber band being stretched over the upper side of the bodies or connecting elements. This simple and rapid type of fastening of the body and/or the connecting elements provides for a firm seating thereof on the circular or curved elements, without it being necessary to use any other supporting material. The rubber bands can preferably have a cross section width that is less or substantially less than the cross section width of the body or bodies, so that an escape of the sealing medium is not substantially hampered on the upper side of the body.

The body consisting according to the invention of foam material or foam material tape is used in an advantageous manner for the sealing of a ground water relief connector. Ground water relief connectors which, for example, pass through bottom plates, with the ground water surface lying above the level of the bottom plate, are wound or entwined with the body at the connecting place of the bottom plate and the relief connector, so that after the introduction of the sealing medium into the body, there is assured a secure sealing against rising ground water at the aforementioned connecting place.

Likewise advantageously, the proposed body can be used for the sealing-off of a connecting place disposed between two pipes, and also can be used in the sealing-off of a pipe socket connecting place. Here, the body is arranged in the area of the gap between the two pipes joined with one another, as it is laid about this area and, as with the relief connector, a ring is formed about the connecting place. After the introduction of the sealing medium into the body, the connecting place is secured in such a away that any fluid possibly escaping from the connecting place can securely be retained.

The object posed at the outset is provided, in respect to the process, by the features of the present invention.

An essential basic thought lies in the insight that it is possible to dispense with one or more external connections for the introduction of the sealing medium, which are arranged outside the second concreting section or the sheathing; the sealing device, therefore, is arranged without connection to the outside in the joint area between the two concreting sections.

All hitherto-known sealing devices, and especially the sealing devices according to the present invention, can be filled with a sealing medium by a subsequent connection between an outside portion of the concrete or the second concreting section and the sealing devices. In the case of the sealing medium, it is a matter, for example, of silicates, or hardening mono-component or polycomponent synthetic substances, in fluid or pressable consistency. Also a synthetic resin, especially a 2-component acrylic resin, can be used as the sealing medium.

The subsequent connection is made, for example, specifically by a bore provided in the hardened concrete between an outside portion of the concrete and the sealing devices. It is obvious that the bore must be extended far enough so that the flow channel or the passage of the sealing device becomes accessible. The sealing medium is thereupon introduced or pressed through the connection or the bore. Advantageously, a further connection is made into the sealing device, through which, in the impressing operation, the air can escape, and which also serves as a control place to determine whether the sealing medium has also penetrated the entire sealing device. It is also thinkable to make a relatively large number of such connections, and to seal these afterwards when the sealing medium emerges from the connecting places.

Preferably, the connection is made directly after the removal of the second concreting section from the form, since at this point of time, the concrete can still be penetrated relatively easily, because at this time it is, to be sure, capable of carrying, but nevertheless not completely hardened. The place, at which the sealing medium is introduced into the sealing device, can be arranged at will. Further connecting places, serving as control points, should be arranged at the beginning or at the end of the joint, in order to check that the sealing medium has also forced its way into the end portions of the sealing device.

According to the local conditions, the connection can be made horizontal, or obliquely above, or obliquely below, in the direction of the sealing device. Preferably, the connecting places will be in predetermined positions, in which case, it can previously be established at what height or under what angle and, above all, how long the connecting place must be made, so that it is assured that the sealing device is met or bored in the desired manner.

With the proposed process for introducing the sealing medium into sealing devices, it is prevented that the sheathing must include one or more interruptions for previously laid connection openings or connection pipes. Further, it is prevented that these previously made connecting place are cracked open or destroyed in the molding or concreting. The carrying capacity or security of the bored concrete is also not diminished by the arrangement of several connecting places, in which context, it should advantageously be heeded that in the area of the connecting places, no reinforcement or at least no strong reinforcement is present.

BRIEF DESCRIPTION OF THE DRAWINGS

The invention is to be described in the following with the aid of preferred examples of execution schematically and by way of example, and illustrated in the accompanying drawings of preferred embodiments in which:

FIG. 20 shows a side view, in cross section, of the sealing device according to the invention in the form of a body of foam material for a ground water relief connector;

FIG. 21 shows a side view, in cross section, of the sealing device of the invention in the form of a body of foam material for a pipe connecting place;

DESCRIPTION OF THE PREFERRED EMBODIMENTS

Figure 1:
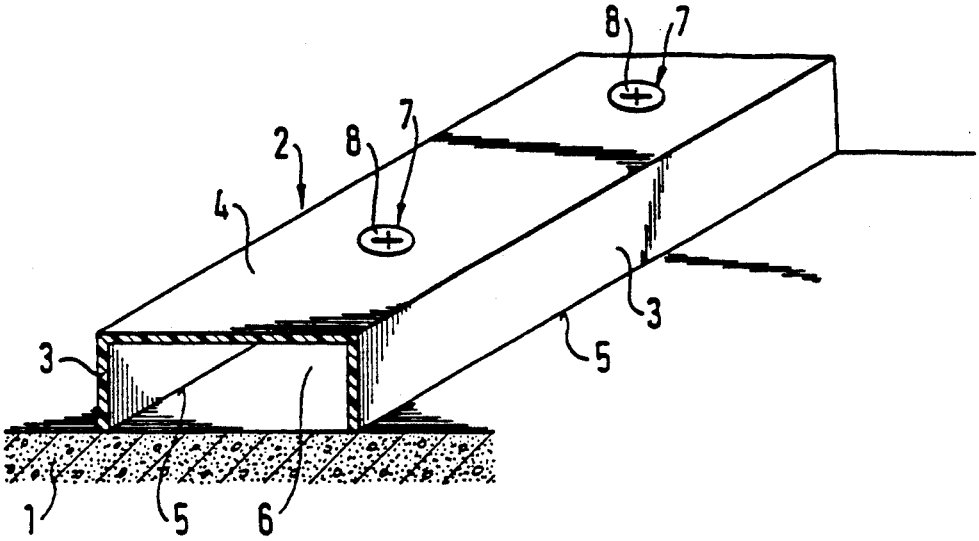
FIG. 1 shows a perspective view of a section of a first form of a sealing device of the invention in the form of a profile.

The sealing device, in the form of profiles, is shown in FIG. 1 to include a profile 2 having a U-shaped cross section, which is mounted on a hardened concrete surface 1. The profile 2 includes a cover wall 4 and two side walls 3, being formed from a plastic material. The plastic profile 2 is mounted on the concrete surface 1 in such a way that the free longitudinal edges 5 of the side walls 3 rest on the concrete surface 1. Thus, a flow channel 6 is formed between the concrete surface 1 and the profile 2.

The profile 2 can be fastened to the concrete surface 1 with straps or the like. Preferably, however, a simple screw engagement is provided, in which a screw 7 is supported with its screw head 8, possibly over a shim (not represented), on the cover wall 4, with the screw shaft extending through a hole in the cover wall 4 and being screwed, for example, in a dowel arranged in the concrete. In place of the screw, a pin or nail (not represented) can also be used, which is driven into the concrete or is shot into the concrete by means of a shooting apparatus, in which process the pin or nail can also secure the profile 2 with or without a head thereon. The latter case can especially be used if the pin or nail engages, when being shot through, the profile 2 with a clamping effect. Thereby, the sealing device of the invention lies fixed in position and cannot be displaced by the applied fresh concrete of a second concreting section. The profile 2 is constructed sufficiently rigid so that it cannot be harmfully deformed or crushed by the applied fresh concrete or by the action of the forces arising with the use of a concrete shaker.

The sealing medium is introduced into the flow channel 6. The sealing medium cannot escape through the walls of the profile 2, because its walls are impermeable to the sealing medium. The sealing medium can, however, force its way to the outside between the longitudinal edges 5 of the profile 2 and the concrete surface 1 see FIG. 23. In which process in a particular environment, always in the areas of the wall connections or the connecting places of the profile 2, the sealing medium seals off untight areas or the receptive areas for the sealing medium. The roughness of the concrete surface normally suffices to make available adequate emergence places for the sealing medium.

Figure 2:
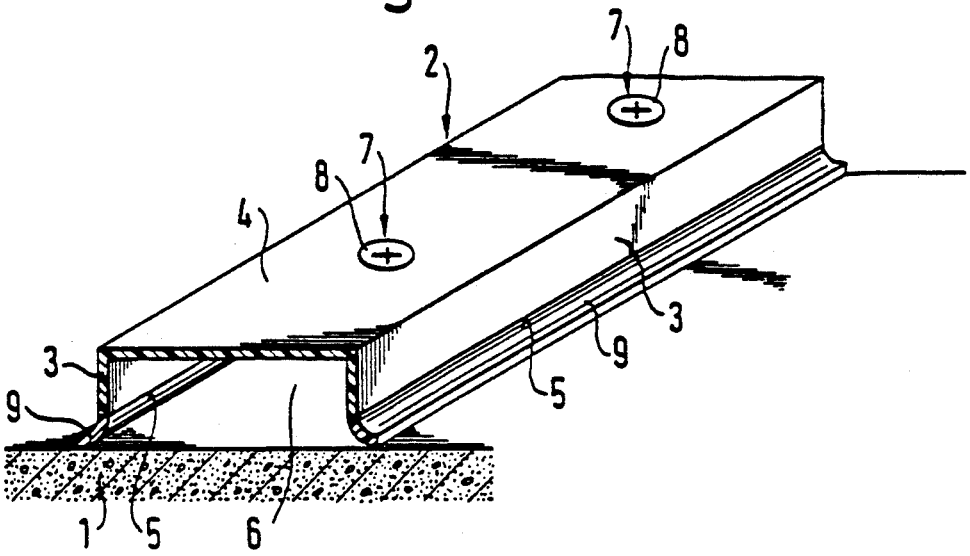
FIG. 2 shows a perspective view of a profile similar to FIG. 1 provided with sealing lips.

A variant is shown in FIG. 2, in which on the longitudinal edges 5, there are formed relatively soft sealing elements or lips 9, especially in one piece, which consist of soft plastic, rubber or the like, and which favor the emergence of the sealing medium into the receptive areas.

Figure 2A:
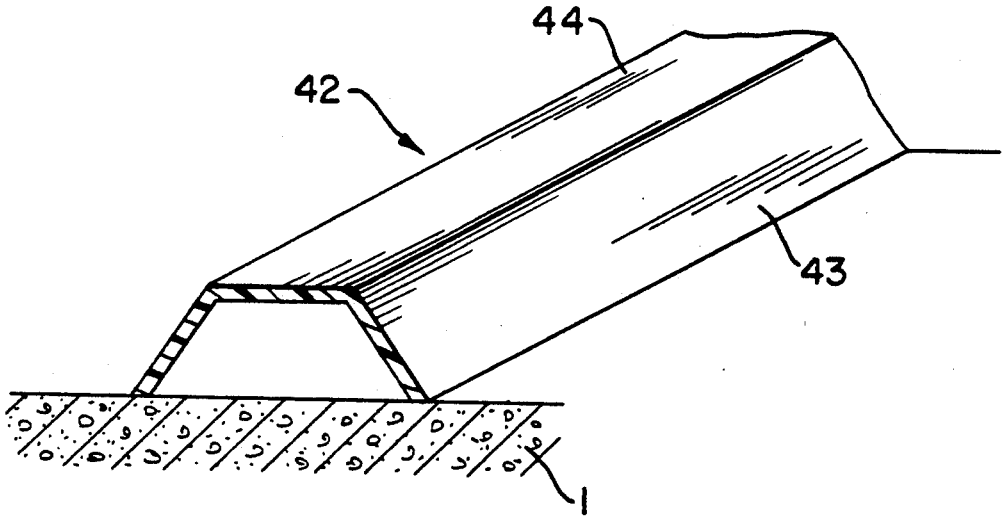
FIG. 2*a* shows a view of a section of a second form of the sealing device of the invention in the form of a modified profile.
Figure 2B:
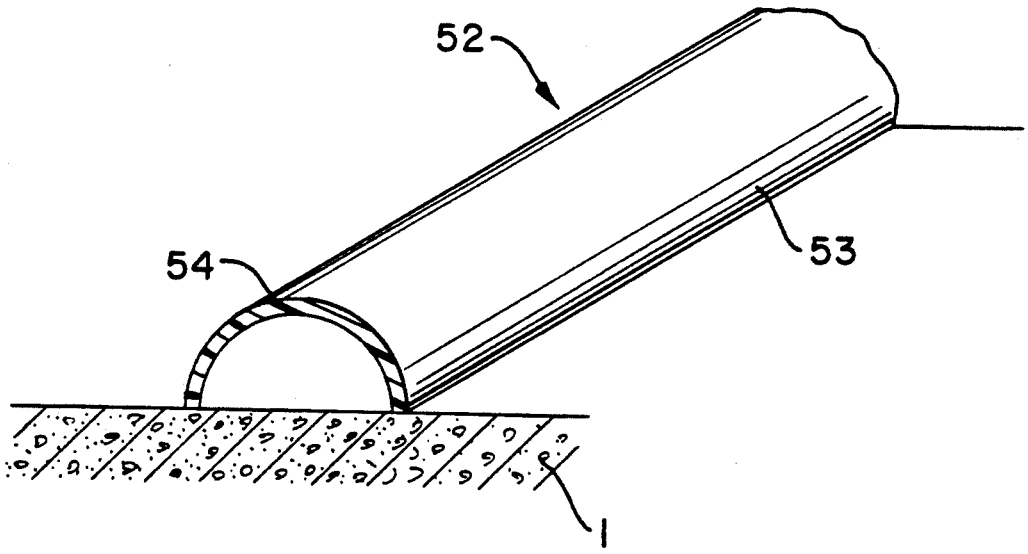
FIG. 2*b* shows a perspective view of a section of a third form of the sealing device according to the invention in the form of a further modified profile.

In FIG. 2*a*, there is shown a profile 42 having a trapezoidal cross section, while the profile 52 shown in FIG. 2*b* has an arcuate cross section. The fastening of the two profiles 42, 52, as well as a modified arrangement thereof having the sealing lips thereon as shown in FIG. 2, is made in an analogous manner as mentioned above. The advantage of the trapezoidal and arcuate cross section forms of the profiles 42, 52 can be seen, inter alia, in that in the stocking of the profiles 42, 52 formed in such a manner, the stackability is substantially improved, so that space can be saved in the storage thereof. Also with these profiles, the side walls 43 or 53 can consist of a more elastic material than the corresponding cover walls 44 and 54 thereof.

In the following figures there is shown, in each case, a profile having a U-shaped cross section. It should be noted, that the advantageous developments that are explained with reference to the following figures, can also be used for other cross section forms of the profile, especially for the cross section forms of the above mentioned profiles 42, 52.

Figure 3:
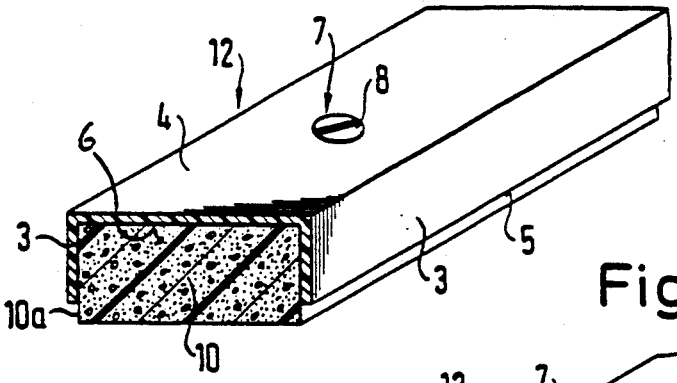
FIG. 3 shows a perspective view of a section of a fourth form of execution of the sealing device according to the invention in the form of another modified profile.
Figure 4:
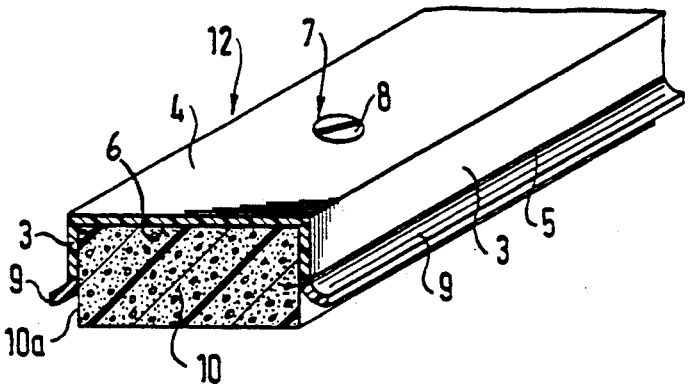
FIG. 4 shows a perspective view of a profile similar to FIG. 3 provided with sealing lips.

In FIGS. 3 and 4, the flow channel 6 is foam filled, in each case, with a plastic strip or a synthetic substance foam 10, which has open passage pores, so that the sealing medium in the flow channel 6 is conducted through the passage pores of the plastic foam 10. Instead of a foam filled profile 12, there can expediently be used a profile 12, in which the plastic foam is in the form of a plastic foam strip, which is preferably cemented in. Advantageously, there is a clearance 10*a*, with which the plastic foam 10 or the plastic foam strip overhangs or extends beyond the longitudinal edges 5 of the profile 12. The clearance 10*a* provides that the longitudinal edges 5 remain somewhat distanced or spaced from the concrete surface 1, so that in this space a larger amount of sealing medium can emerge. The plastic foam will possibly be pressed somewhat into the space of the clearance 10*a*, but the longitudinal edge 5 of the profile 12, now as before, will be spaced from the concrete surface 1. The profile 12, filled in this manner and provided with or without the clearance 10*a*, can additionally be provided with sealing lips 9. With the clearance 10*a* and/or the sealing lips 9, there can also be compensation made for the relatively great unevennesses of the concrete surface 1, so that an especially smooth or flat concrete surface is not required before the mounting of the sealing device.

Figure 5:
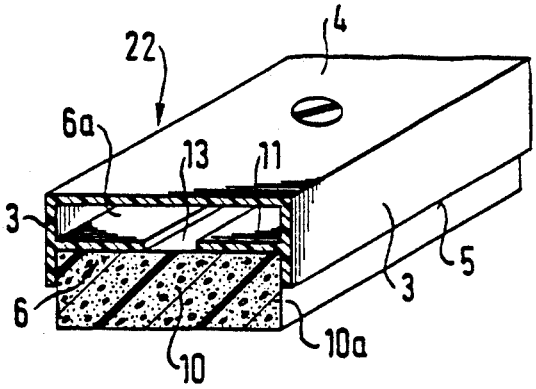
FIG. 5 shows a perspective view of a section of a fifth form of the sealing device according to the invention in the form of a further modified profile.
Figure 6:
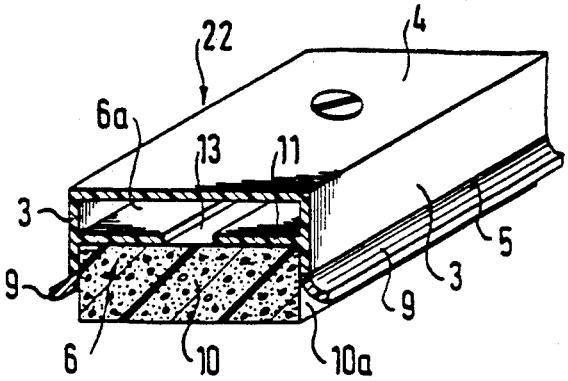
FIG. 6 shows a perspective view of a profile similar to FIG. 5 provided with sealing lips.

A variant of the sealing device is shown in FIGS. 5 and 6, in which in longitudinal direction of the profile 22 underneath the cover wall 4, there is provided a free passage channel 6*a*. A bottom wall 11 thereof is arranged at about the middle of the height of the side walls 3, which includes a longitudinal slit 13. Under the bottom wall 11, the flow channel 6 is foam filled with a plastic foam 10 or a synthetic foam strip, as is also shown in FIGS. 3 and 4. Likewise, a clearance 10*a* of the synthetic foam 10 or of the synthetic material strip and/or a sealing lip 9 can be provided. Instead of a slit 13 or in combination with a slit 13, there can also be provided holes or similar openings in the bottom wall 11.

In this alternative form of execution of the sealing device, the sealing medium is first introduced or pressed or injected into the passage channel 6*a*, and then it passes through the slits 13, or holes possibly provided in the bottom wall 11, into the synthetic material foam 10 in the flow channel 6, and from there under the longitudinal edges into the areas receptive for the sealing medium, and also to be sealed off in the joint between the first and second concreting section(s), for example, a wall connection.

Figure 6A:
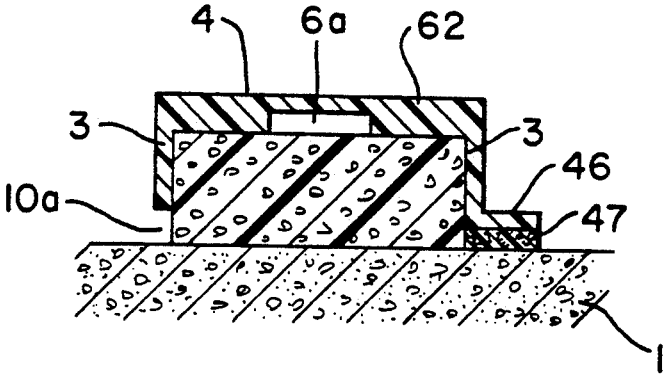
FIG. 6*a* shows a perspective view of a section of a 6th form of the sealing device according to the invention in the form of a still further modified profile.
Figure 7A:
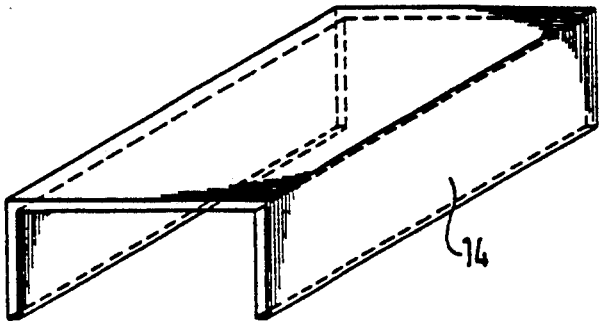
FIGS. 7*a* to 7*e* show perspective views of connecting pieces for the abutting edges of the sealing device of the invention in the form of a profile.
Figure 7B:
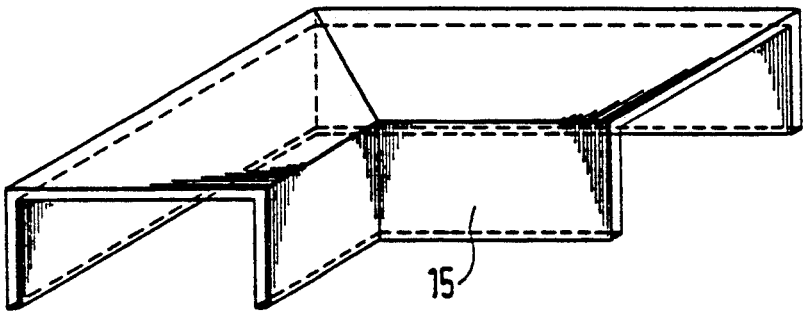
Figure 7C:
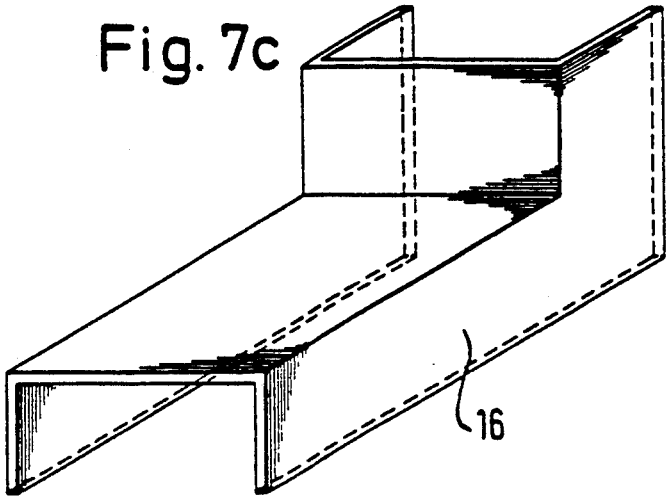
Figure 7D:
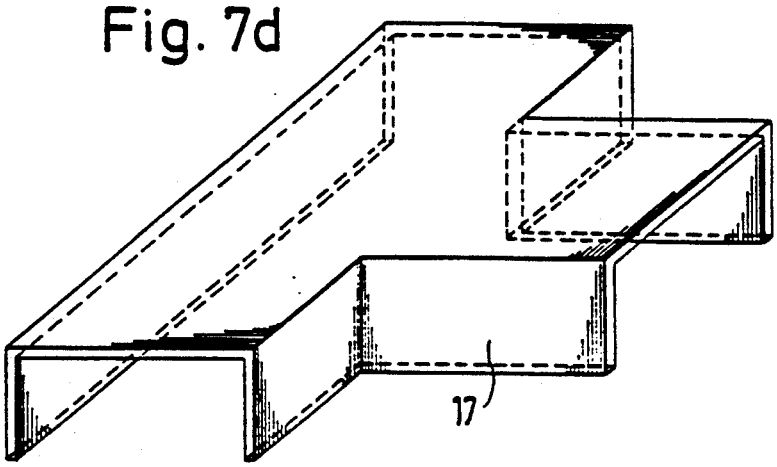
Figure 7E:
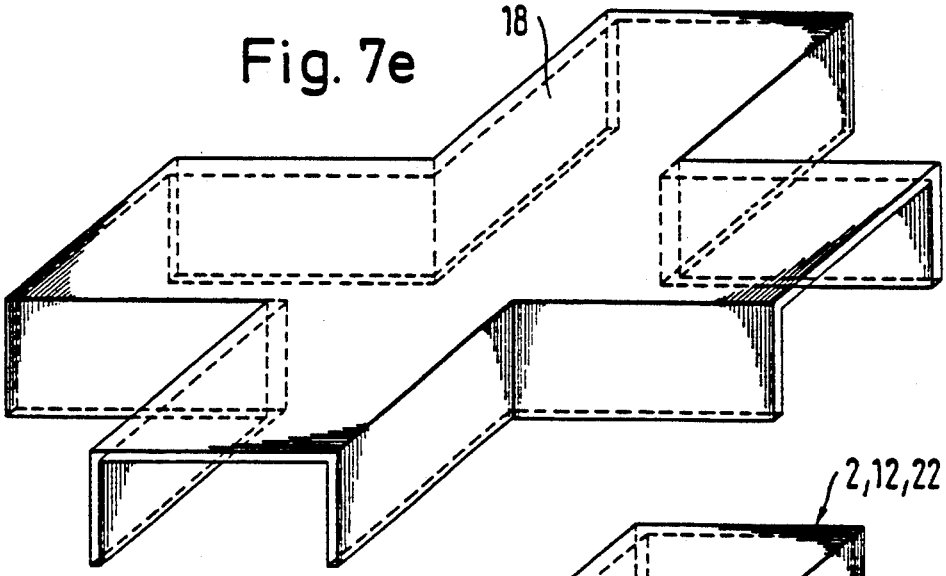

FIG. 6*a* shows in cross section a further alternative of a profile 62. In this profile 62, the passage channel 6*a* is in the inner surface of the cover wall 4 facing the flow channel 6, being formed by a groove running in the longitudinal direction of the profile 62, so that the groove represents the free passage channel 6*a*. As explained for FIGS. 5 and 6, the sealing medium is first introduced into this free passage channel 6*a*. After the passage channel 6*a* has been filled, the synthetic foam 10 provided in the flow channel 6 is saturated with the sealing medium, and thereupon emerges in a desired manner in the area of the free longitudinal edges 5.

The cross section of the profile 62 represented in FIG. 6*a* is shown on its left side without any sealing lips 9, whereby there is provided the already explained clearance 10*a*. In an alternative manner it is possible, as represented on the right side of the cross section, to provide a flange 46 which is a horizontal extension of the side wall 3, in which case underneath the flange, facing the concrete surface 1, a foam substance band 47 is provided. This foam material band 47 is somewhat compressed in the fastening of the profile, but remains porous enough so that the sealing medium can emerge at the free flange end thereof through the foam material band 47. Additionally it is possible to fasten the profile 62 by the flange 46 to the concrete surface 1.

The proposed sealing device is per se especially simply constructed and makes available, therefore, the use of also correspondingly simple connecting elements between the abutting edges of two profiles 2, 12, 22, 42, 52, 62. The dimensions of the connecting elements are chosen in such a way that they can be slipped, for example, in a fixed form and/or in a fixed linkage, onto the profiles 2, 12, 22, 42, 52, 62.

FIGS. 7*a* to 7*e* make it clear that straight connecting pieces 14 (FIG. 7*a*), flat corner angles 15 (FIG. 7*b*), upright corner angles 16 (FIG. 7*c*), T-pieces 17 (FIG. 7*d*), crossing pieces 18 (FIG. 7E) are usable. However, also any otherwise formed connecting elements are also possible. The connecting elements can be fastened in the aforementioned manner by screws, pins, nails or the like, preferably together with the profiles 2, 12, 22, 42, 52, 62 on the concrete surface 1, or glued onto the profiles 2, 12, 22, 42, 52, 62, or supported on these with positioning means.

It is also possible, however, to establish a connecting place so that the chosen connecting elements include in their cross section form exactly the shape of the profiles 2, 12, 22, 52, 52, 62. The profiles 2, 12, 22, 42, 52, 62 are then simply applied to the connecting elements, i.e. laid on abutment with them. The connecting place, as a cross section, can then simply be covered with an adhesive band, so that any slipping of the sealing device is prevented. The fastening of the individual profiles 2, 12, 22, 42, 52, 62 as well as of the connecting elements can then occur in a usual manner. The adhesive band can also be conducted in several layers over the abutment place, in which process the adhesive band should reach maximally into the region of the free longitudinal edges 5 at the abutment place or shortly in front of it. A complete wrapping of the abutment or connecting place is not recommended, since the emergence of the sealing medium in this area would be prevented.

Figure 8:
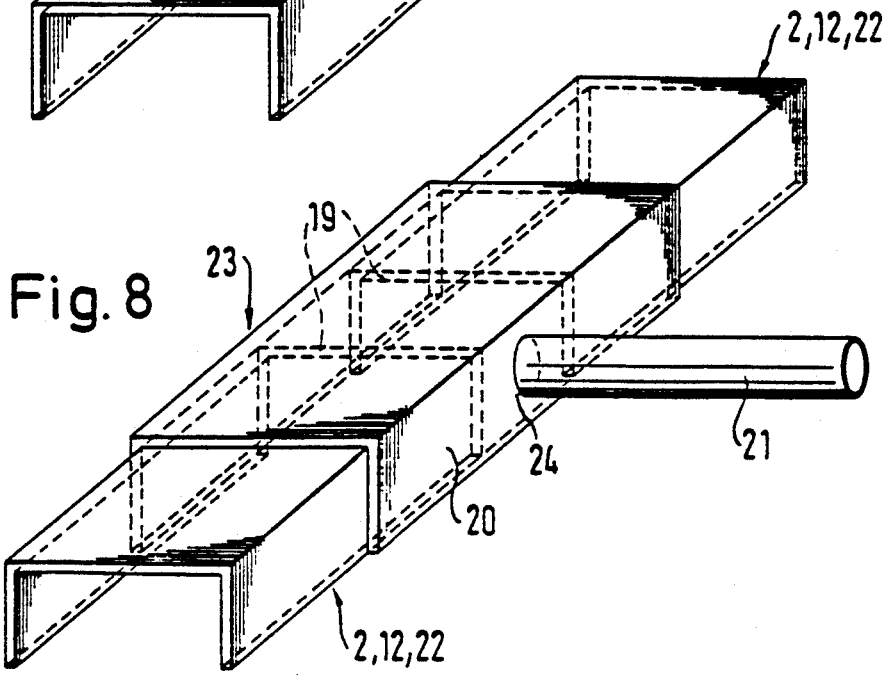
FIG. 8 shows a perspective view of a press-in connector for the sealing device of the invention in the form of a profile.

FIG. 8 shows that for an especially simply formed connecting place for the impressing of the sealing medium in the sealing device, the abutting edge 19 of two profiles 2, 12, 22 can be spaced apart, and that over the abutting edge space there is set a press-in connector 23, being snugly and/or in a closed linkage, which is adapted in its dimensions to the profiles 2, 12, 22. The connector 23 can include, for example, the spatial form of the connecting piece 14, in which case a movable, load-bearing, nonporous flexible tube 21 is used in a hole 24 arranged, for example, on a side wall 20 on a cutting piece applied there, which is present in the space between the abutting edges 19.

In this connecting place it should once again be remarked that, on the one hand, also other cross section forms of profiles, especially the profiles 42, 52, 62, can have a connecting place formed according to FIG. 8. Furthermore, in particular, it is also possible to have the profiles 2, 12, 22 abut directly onto the press-in connecting piece 23, if the press-in connector 23 includes the cross section form of the profiles 2, 12, 22 in an identical manner.

Figure 9A:
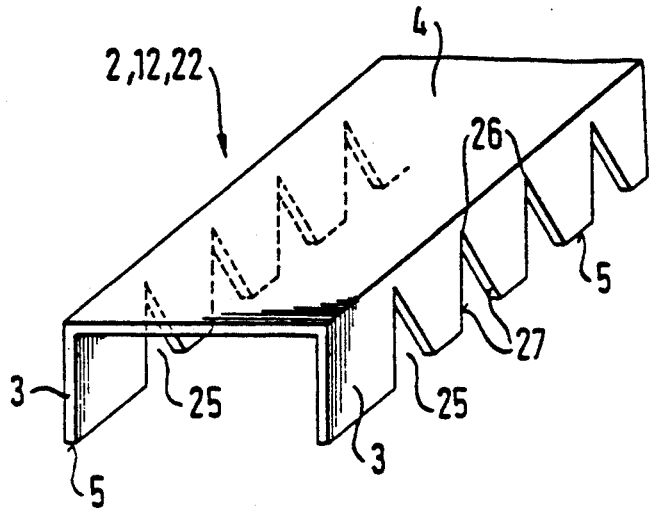
FIGS. 9*a* and 9*b* show perspective and side views, respectively, of the sealing device of the invention in the form of a profile, particularly as a sleeve for tubular bodies.

The profiles 2, 12, 22 can be laid not only on the flat concrete surfaces 1, but also on arcuate or curved or round surfaces, for example of pipes or tubes, which are surrounded or wrapped in sleeve fashion with the profiles 2, 12, 22. For this purpose, notches 25 are stamped out of the side walls 3 of the profiles 2, 12, 22 or are left out in the shaping of the profiles 2, 12, 22, which end with their notch apexes 26 on the cover wall 4 or shortly spaced from the cover wall 4, as is shown in FIG. 9*a*.

Figure 9B:
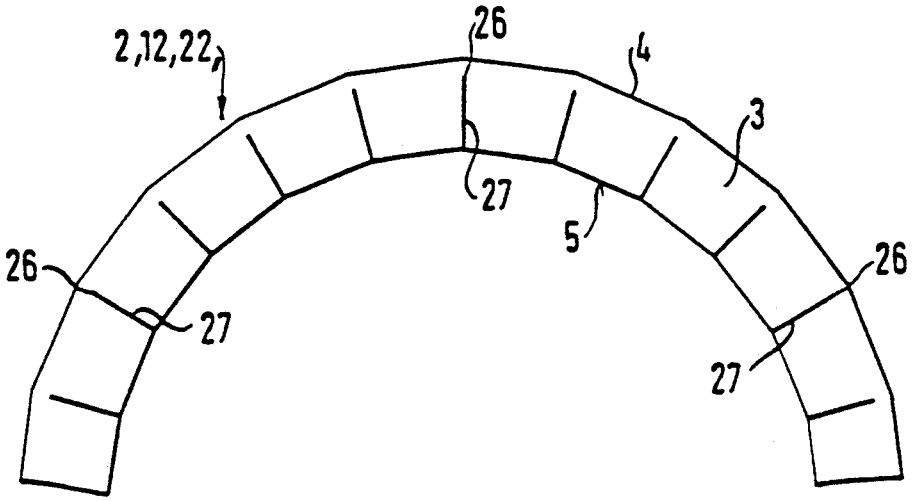

Such a profile 2, 12, 22 can, in correspondence to FIG. 9*b*, be bent into a bow, preferably into a ring (not represented), because the material of the profiles 2, 12, 22, which preferably consists of plastic, is sufficiently flexible. The profile 2, 12, 22 is set against the mantle surface, for example a pipe (not represented), and correspondingly bent and fastened to the pipe. There it is expediently provided that the side edges 27 of the notches 25 abut against one another. Thereupon, in the region of the profiles 2, 12, 22, there is concreted about the pipe a second concreting section. Over feed arrangements (not represented) thereupon the sealing medium is conducted into the interior of the profiles 2, 12, 22, from which it can force its way along the longitudinal edges 5 and/or through the abutting edge slits of the notches 25 into receptive cavities. In the laying of the profiles in the manner shown on curved or bent surfaces, there is sought a closing of the notches 25, i.e. an abutting on one another of the side edges 27, lying opposite one another, of the notches 25 when the longitudinal edges 5 of the profiles 2, 12, 22 lie firmly on the respective curved or bent surface.

Figure 10:
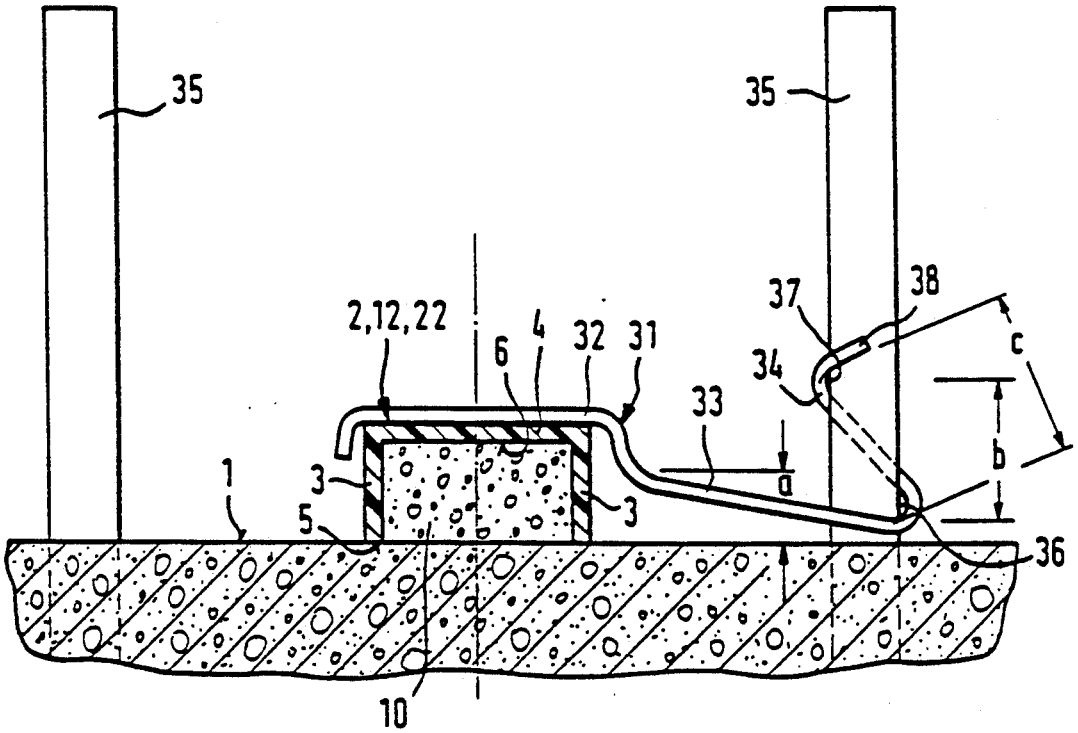
FIG. 10 shows a side view, in cross section, of a sealing device held by a strap in the form of a profile.

The profiles 2, 12, 22, 42, 52, 62, the connecting elements *7a* to *7e* and the press-in connector 23 can advantageously be held together also by a strap 31, in which case a clamping strap is used which exerts a certain bias tension against the profiles 2, 12, 22, 42, 52, 62 or the connecting elements *7a* to *7e* or the press-in connectors 23, and thus tensions these against the concrete surface 1. Such a strap 31 can be constructed in the form of a usual pipe strap, so that a lateral fixing is provided. The strap 31 can be fastened to the concrete or to the concrete surface 1 by means of a fastening element gripping through its fastening tab, in particular a screw, a pin or a nail—as shown or described in the case of the fastening for the profiles 2, 12, 22. For reasons of saving time in the mounting, a strap support is to be preferred in which the strap 31 is secured by plugging into a fixed form support. An example for this is shown in FIG. 10, in which by way of example, there are shown the profiles 2, 12, 22. However, also the other profiles 52, 42, 62, the connecting elements *7a* to *7e*, as well as the press-in connector 23 can be secured in the same manner.

The strap 31 grips over the profile 2, 12, 22 in a pipe-strap form, and is bent for this purpose approximately in a U-form at its supporting end, so that the profile 2, 12, 22 is also laterally held. From the U-shaped supporting part 32, there extends at a distance a from the concrete surface 1, a horizontally or somewhat inclined holding arm 33, which is continued into a supporting arm 34, which embraces a reinforcing rod 35 extending perpendicularly to the concrete surface 1 and, extending preferably obliquely to the holding arm 33, likewise winds about the side of the reinforcing rod 35 facing the profile 2, 12, 22. The wrap-around points 36, 37, at a distance b from one another directed transversely to the concrete surface 1, provide countersupports, therefore, which secure the strap 31 against lifting-off from the profile 2, 12, 22. Preferably, the strap 31 consists of an elastic material, especially spring steel, with the holding and supporting arm 33, 34 being arranged at such a distance from the concrete surface 1 and the reinforcing rod 35, that the holding arm 33 is biased-tensioned against the concrete surface 1. Between the end part 38 of supporting arm 34 and the holding arm 33, there is provided a spacing c which is greater than the cross section dimension or the diameter of the reinforcing rod 35. This formation makes it possible to thread the supporting arm, by gripping-around and tilting, into the mounting place represented. The strap 31 consists preferably of a round wire. The sealing device or the profile 2, 12, 22 is preferably arranged centrally between the reinforcing rods 35 represented. It is thus possible to hold like straps 31 at will or alternately on reinforcing rod 35 represented in FIG. 10, left in a fixed form and/or in also in a fixed linkage.

Finally it should still be mentioned that all the profiles 2, 12, 22, 42, 52, 62 shown, as well as the connecting elements *7a* to *7e*, and the press-in connectors 23 consist of elastic material, preferably synthetic material.

Figure 11:
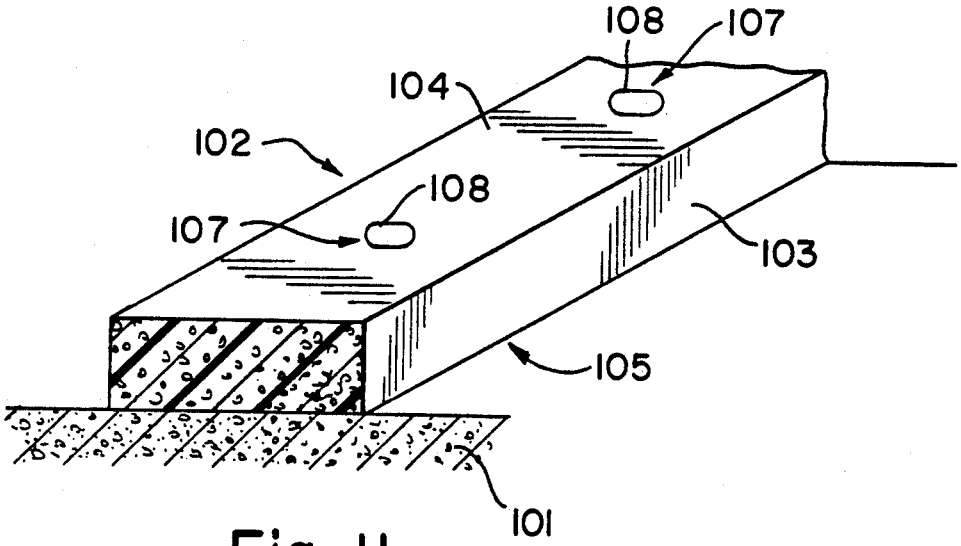
FIG. 11 shows a perspective view of a section of a first form of the sealing device according to the invention in the form of a body of foam material.
Figure 24:
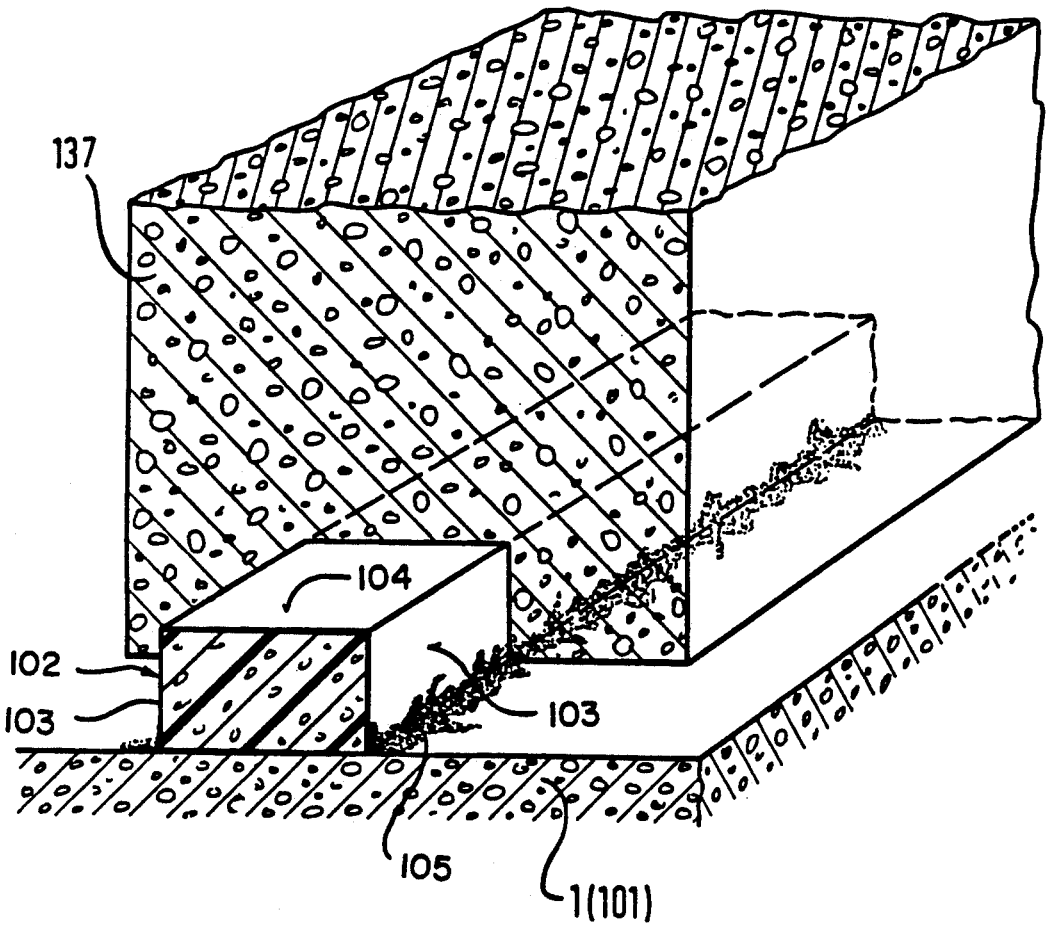
FIG. 24 shows a perspective view of a cross section similar to FIG. 23, showing the profile of FIG. 11 disposed between two concrete sections with the sealing medium emerging therebetween.

An alternative sealing device according to the invention is shown in FIG. 11, in which as the sealing device there is used a body 102 of foam material or a foam material band. The body 102 is placed with its underside 105 on a hardened concrete surface 101 and mounted there. The mounting can occur through various support arrangements, there being shown in FIG. 11 as an alternative, a fastening by a screw 107. There can also be used pins or nails, preferably together with shims. In the screw 107 represented, the screw head 108 should be constructed with a large surface, so that the screw head 108 can be fixed over as large a part of the body 102 as possible. The supporting arrangement is introduced only so far a distance into the concrete surface 101 that allows its upward-directed free end, for example the screw head 108, to lie about in a plane with the upper side 104 of the body 102. The required passage or flow channel for the sealing medium in this sealing device is formed by the body 102 itself, in which arrangement the sealing medium, by reason of the porous property of the body 102, can pass through the passage pores of the latter and can emerge into the joint area. The sealing medium emerges in the space between the concrete surface 101 and the underside 105 of the body 102, as shown in FIG. 24, as well as from its upper side 104 and its side surfaces 103 into the joint area.

A fastening of the body 102 can also be carried out advantageously with the aid of the supporting arrangement described in FIG. 10, to the functioning and formation of which reference is hereby expressly made.

Figure 12:
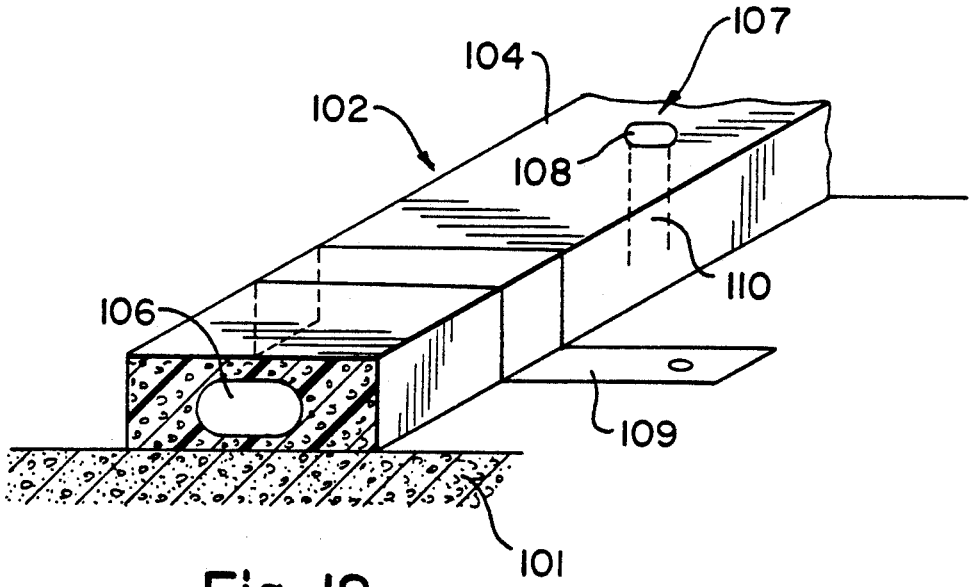
FIG. 12 shows a perspective view of a body similar to FIG. 11 provided with an added passage channel and an alternative supporting arrangement.
Figure 13:
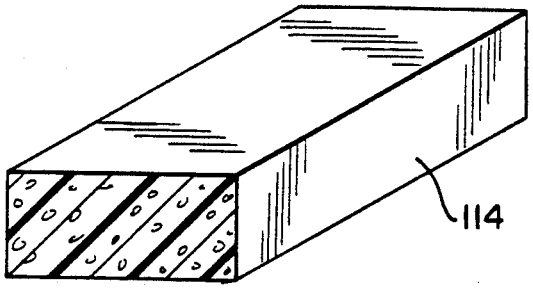
FIGS. 13 to 17 show perspective views of connecting pieces for abutting edges of the sealing device of the invention, each in the form of a body of foam material.
Figure 14:
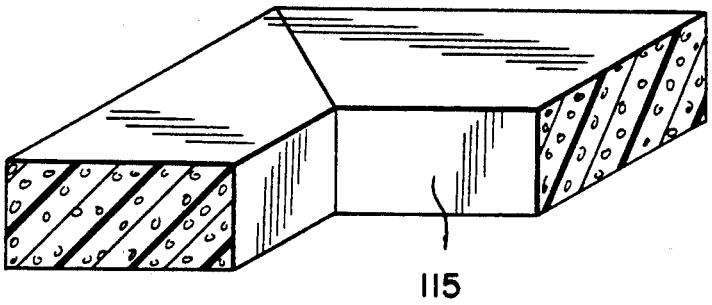
Figure 15:
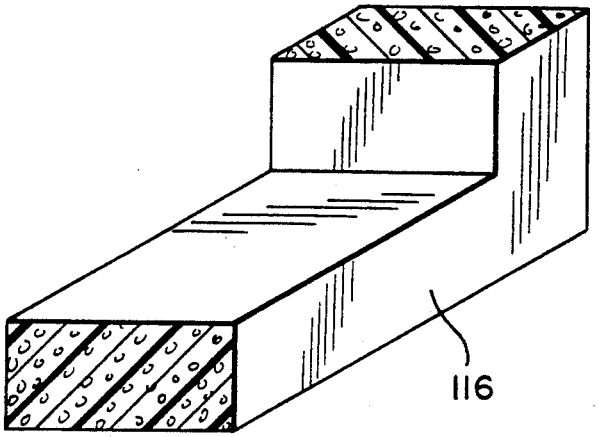
Figure 16:
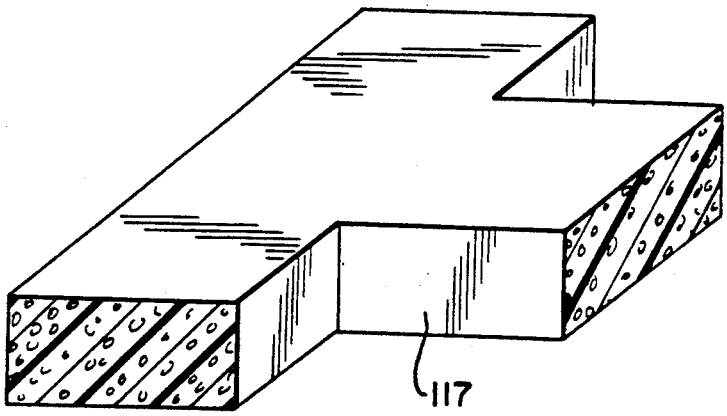
Figure 17:
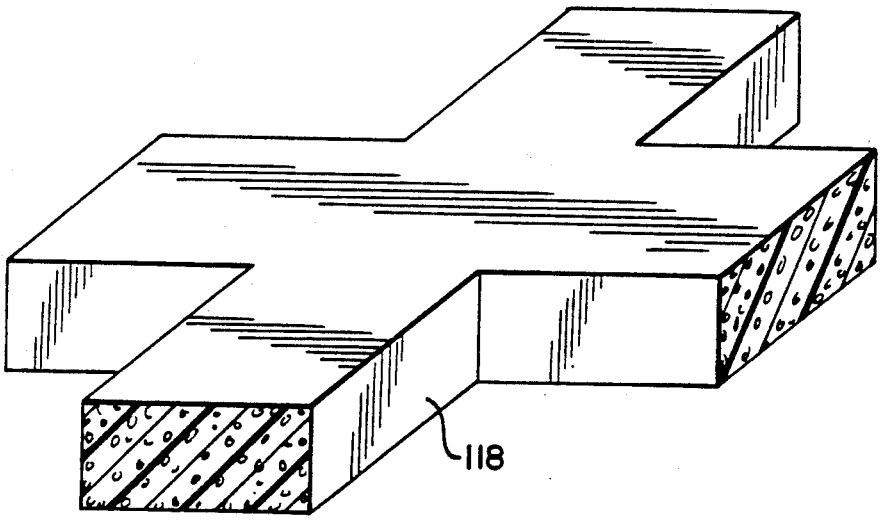

In FIG. 12 there are shown, first of all, further alternative support arrangements for the body 102. The screw 107 represented, as well as pins or nails, can be grasped by a tubular spacer 110 in the shaft portion, the length of which corresponds to the cross section height of the body 102. Thus, in the introduction of the screw 107 or, for example, in the shooting-in of a pin, it is assured that the screw head 108, or the head of a pin, does not penetrate into the body 102, but comes into position to lie in the plane of the upper side 104 of the body 102. In an alternative manner, a supporting can also occur by a support profile 109, which is formed U-shaped in cross section on a portion of the body 102 to grip about the side surfaces 103 as well as the upper side 104 of the body 102. A side shank of the support profile 109 is directed to the concrete surface 101, and bends off at about a right angle, in order to form a flange portion which rests on the concrete surface 101. In this flange portion, there can take place the fastening of the support profile 109 to the concrete surface 101, for example by means of a shot-in pin or nail.

In FIG. 12, it is further represented that the body 102 includes in its cross section interior a recess running in a longitudinal direction, which serves as a free passage channel 106 for the sealing medium. The sealing medium introduced into the body 102 will, therefore, first fill the free passage channel 106 of the body 102, and then emerge through the porous material of the body 102 into the joint area. Alternatively, the cross section interior of the body 102 can also have several adjacently running, continuous recesses.

In FIGS. 11 and 12, there is shown a preferred cross section form of the body 102 in the form of a slab, and thus providing a rectangular cross section, in which the cross section width is preferably 30 mm, and the cross section height is preferably 20 mm. The same advantageous properties of this sealing device can be achieved, however, also with bodies which have a trapezoidal or circular type cross section, or also arbitrarily differently formed cross sections. A separate representation of alternative cross section forms of the sealing device was dispensed with here. This possibility of alternative cross section forms of the sealing device applies also to the connecting elements described in the following FIGS. 13 to 17, as well as to the press-in connector body 123 represented in FIG. 18.

For the connecting of at least two bodies 102, there are provided between their abutting edges, connecting elements having the same cross section form and consisting of the same material, which are represented in FIGS. 13 to 17, and represent a nonconclusive selection of preferred connecting elements. The use of these connecting elements is not only for the aforementioned joining of two bodies 102, but also for the possibility of a direction change with the aid of such connecting elements. The bodies 102 are simply placed against the connecting elements so that their free connecting ends lie snugly against one another. FIGS. 13 to 17 make it clear that straight connecting pieces 114 (FIG. 13), flat corner angles 115 (FIG. 14), upright corner angles 116 (FIG. 16), T-pieces 117 (FIG. 16) and crossing pieces 118 (FIG. 17), for example, can be used. The connecting elements are fastened in the manner already described by means of screws, pins, nails or supporting profiles, as well as the bodies 102 to the concrete surface 101.

Figure 18:
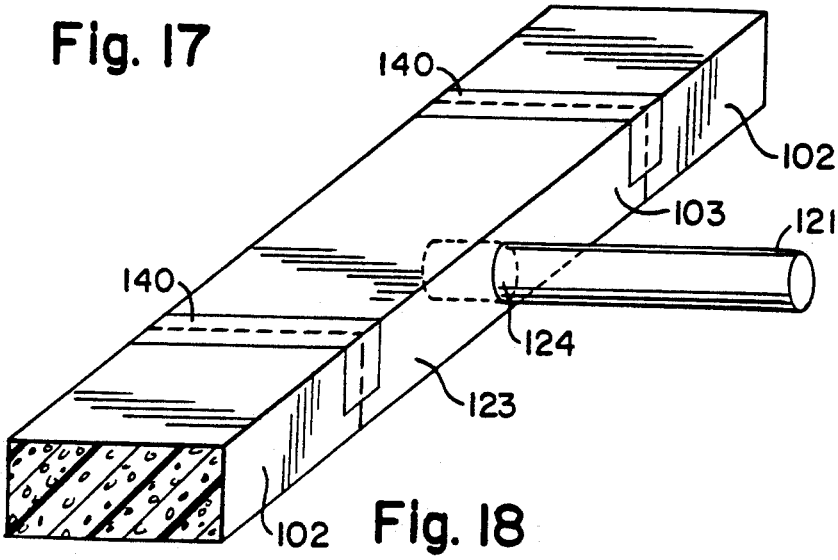
FIG. 18 shows a perspective view of a press-in place for the sealing device of the invention in the form of a body of foam material.

The joining of the bodies 102 with one another or of the bodies 102 with the connecting elements at the respective abutment places occurs preferably with the aid of an adhesive band 140, which is laid over the abutment place, in which case the adhesive band 140 preferably covers only the upper side 104 and the side surfaces 103, as shown in FIG. 18. In this arrangement, the adhesive band 140 on the side surfaces 103 can be end spaced from the concrete surface 101, so that in this space the sealing medium can also emerge from the area of the abutment place. The adhesive band 140 serves principally for securing the position, i.e. a lateral shifting in the abutment area and a shifting in longitudinal direction are avoided with the aid of the adhesive band 140.

In FIG. 18, there is shown a press-in connector body 123, on one side surface 103 of which, there is arranged an elastic, load-bearing nonporous flexible tube 121 in the hole 124. This tube 121 serves as a filling connector for the sealing medium, and is arranged with its free end outside the second concreting section or outside its sheathing. The tube 121 ends preferably in the cross section interior of the press-in connector body 123, or in the free passage channel 106 in the event that such should be provided. The sealing device will preferably have in another place, especially in the end zone of the sealing device, a further press-in connector 123, with which it can be checked whether the sealing medium has also found its way through the entire sealing device in the impressing. In order to have several control points or impressing places for the sealing medium, there can also be provided a plurality of such press-in connector bodies 123.

Figure 19A:
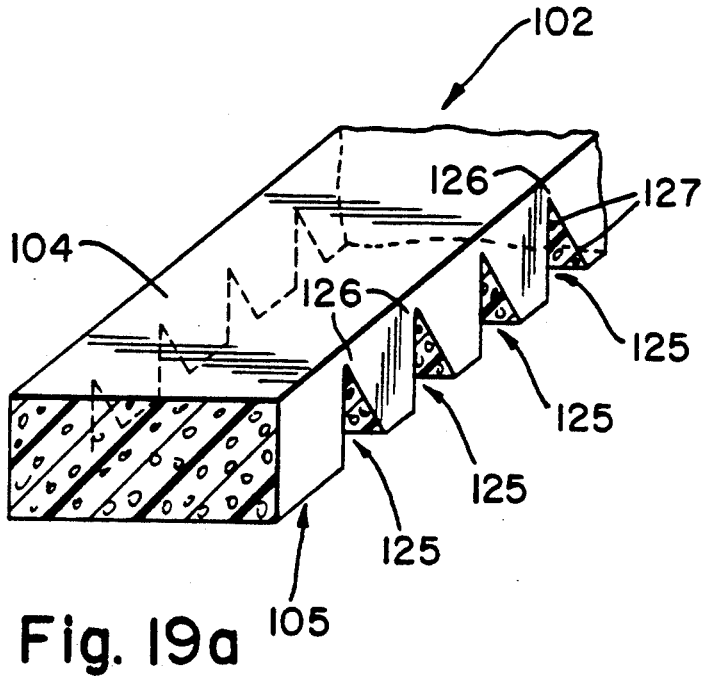
FIG. 19*a* and 19*b* show perspective and side views, respectively, of the sealing device of the invention in the form of a body of plastic, particularly as a sleeve for tubular bodies.

The body 102 can be laid not only on flat concrete surfaces, but can also surround arcuate or circular surfaces, for example pipes or tubes, or follow curved concrete surfaces. For this purpose, there are provided V-shaped, notch type incisions arranged transversely to the longitudinal axis of the bodies 102, or of the connecting elements, or of the press-in connector body 123 arranged adjacently in a longitudinal direction, as is shown in FIG. 19*a*. These incisions include notches 125, the notch apex 126 of which in each case ends somewhat below the cross section height or the upper side 104 of the body 102.

Figure 19B:
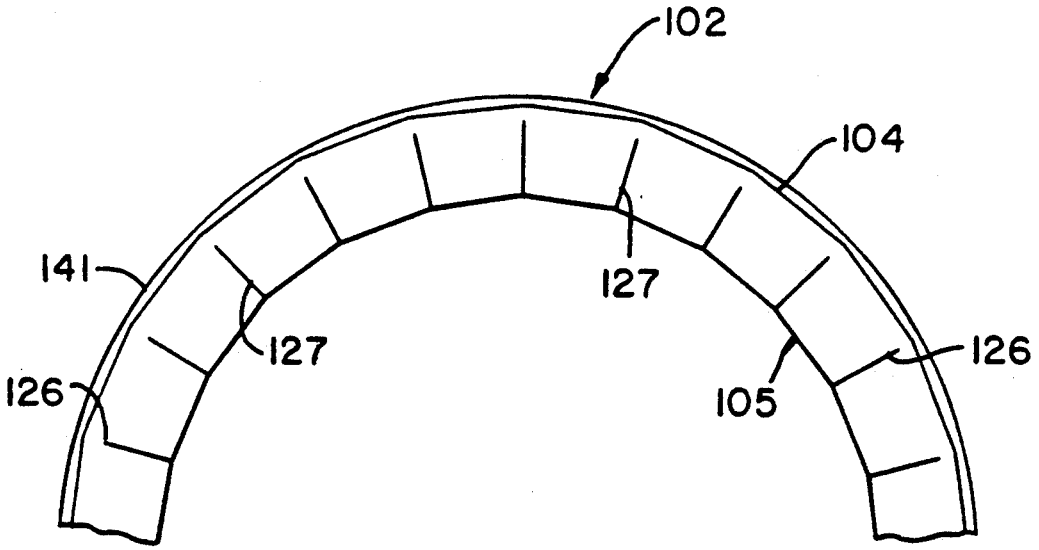

Such a body 102 having the notches 125 can then, as is shown in FIG. 19*b*, either follow an arcuate course or be bent into a ring (not represented) since the body 102 is sufficiently flexible. The body 102 is then set, for example, against the mantle surface of a pipe (not represented) and correspondingly bent, and thereupon fastened to the pipe. It is expediently provided that the notch edge surfaces 127 touch or lie against one another when the underside 105 lies, for example, on the pipe mantle surface. Thereby, it is assured that the annularly formed body 102 provides a further continuous foam material band and has no faulty places into which the concrete of the second concreting section can penetrate to prevent a passage of the sealing medium. After the subsequent concreting process of the second concreting section, the sealing medium is conducted or pressed over feet arrangements (not shown) into the body 102, from which it can then penetrate with sealing effect into the cavities to be filled of the joint area. A preferred fastening of the body 102, or of the connecting elements, or of the press-in connector body 123 occurs on circular elements with an endless rubber band 141, as the rubber band 141 is stretched over the upper side 104, for example, of the body 102 or other elements mentioned. The rubber band 141 provides for a tight hold of the annularly formed sealing device on the corresponding circular element. The width of the rubber band 141 can preferably be less than the cross section width of the upper side 104 of the body 102, so that also in the area of the upper side 104, a sufficient amount of sealing medium can emerge into the joint area to be sealed off.

In FIG. 20, there is shown a preferred use of the body 102, and/or of its connecting elements, and/or of the press-in connector body 123, for the sealing of a ground water relief connector 131. The body 102 is provided with the notches 125, as is shown in FIG. 19*a* or 19*b*. The body 102 is annularly disposed on the ground water relief connector 131 in the area in which the ground water relief connector 131 passes through the bottom plate 132 that is made of concrete. This place in the bottom plate 132 is especially endangered by penetrating ground water or moisture especially when, as represented, the ground water level 133 lies above the bottom plate 132. Before the concreting of the bottom plate 132—with artificially lowered ground water level 133—the body 102 is laid in a ring pattern about the ground water relief connector 131 and fastened thereto for example, with the rubber band 141 mentioned. After the concreting of the bottom plate 132, by previously arranged filling arrangements or with the aid of another process according to the present invention, the sealing medium is pressed into the body 102. The joint area between the ground water relief connector 131 and the bottom plate 132 is completely sealed after the emergence of the sealing medium from the body 102 into the cavities present there.

A further advantageous use of the body 102, and/or of the connecting elements as well as of the press-in connector 123, is shown in FIG. 21, in which the body 102 is used for the sealing of a connecting place between two pipes 134, 135. The pipes 134, 135 are set against one another using a Z-shaped connecting place 136. This connecting place 136 is a weak place in pipe lines with respect to the emergence of media conducted in the pipe lines. In order to additionally seal this weak place, the body 102 is applied directly at the connecting place 136, so that it grips annularly about this connecting place 136. The body 102 is shaped before its application at the connecting place 136 in the manner shown in FIGS. 19*a* and 19*b*. The fastening of the body 102 to the connecting place 136 is preferably made with the rubber band 141 mentioned above. The pipe connecting place 136, as represented in FIG. 21, as a rule is surrounded by a medium, for example mortar or earth or the like. The sealing of the connecting place, i.e. the introduction of the sealing medium into the body 102, occurs preferably after completion of the entire pipe connection so that possibly the connecting place 136 is already surrounded with a certain medium. The sealing medium is introduced into the body 102 in the manner explained above for FIG. 20. Since, in this case, a sealing is required exclusively at the connecting place 136, the two pipes 134, 135, the upper side 104 and the side surfaces 103 can be sealed with, for example, an adhesive band, since an emergence of the sealing medium, as can be seen, is required only in the direction of the two pipes 134, 135. The sealing of the upper side 104 can occur preferably by the arrangement of the rubber band.

In an analogous manner, the body 102 is also suited advantageously for the sealing of a pipe socket connecting place, in which case the body 102 is preferably arranged obliquely to the pipe socket or is adapted in its cross section to the pipe socket connecting place, for example, includes a triangular cross section.

Figure 22:
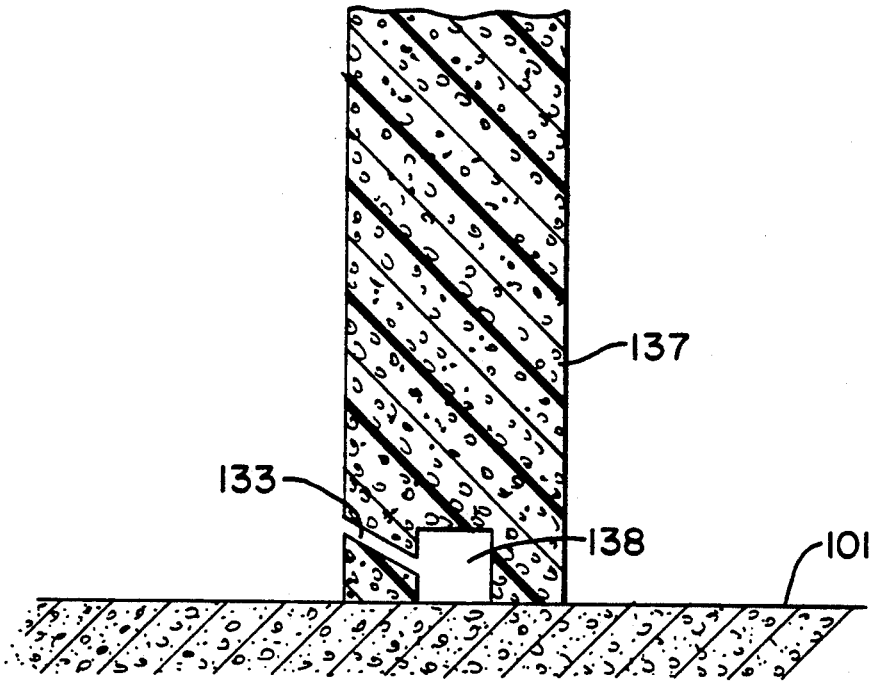
FIG. 22 shows a side view, in cross section, of a diagrammatic representation of the process of the invention for the introduction of a sealing medium into sealing devices.

FIG. 22 shows, once again in a plain representation, the process according to the invention for the introduction of a sealing medium into sealing devices for the sealing of a joint arising between two concrete sections. In the sealing devices arranged in the joint area, it can be a matter of already known sealing devices or of other sealing device according to the present invention. By way of example, the joint area between the concrete surface 101 and a concrete wall 137 on it, is shown. In the joint area, there is schematically represented a sealing device 138, which has been applied before the encasing and concreting to the concrete surface 101. Instead of the previously to-be-arranged filling connectors, which as a rule provide hose-type connections to the sealing device, in this process of the invention, the sealing device 138 is concreted-in without such a connection or a similarly constructed connection. After the concreting and demolding of the concrete wall 137, there is created a subsequent connection or bore 139, especially by drilling into the concrete of the concrete wall 137, between the outside of the concrete wall 137 and the sealing device 138. Through this bore 139, the sealing medium is finally introduced or pressed into the interior of the sealing device 138. Preferably, several such connecting places or bores 139 are provided, so that the sealing medium can be introduced in several places, and there are also control places present at which it is possible to check whether the sealing medium has also forced its way through the entire sealing device. Control or imput places in the form of bores 139 are arranged preferably in the beginning or end portion of the joint—as seen in the longitudinal direction. The drilling process is unproblematic, since the freshly set up concrete 137, after the mold removal, is to be sure stable, but nevertheless not completely hardened. It is left to the local circumstances whether the connection is conducted preferably horizontally or obliquely to the sealing device 138.

Figure 23:
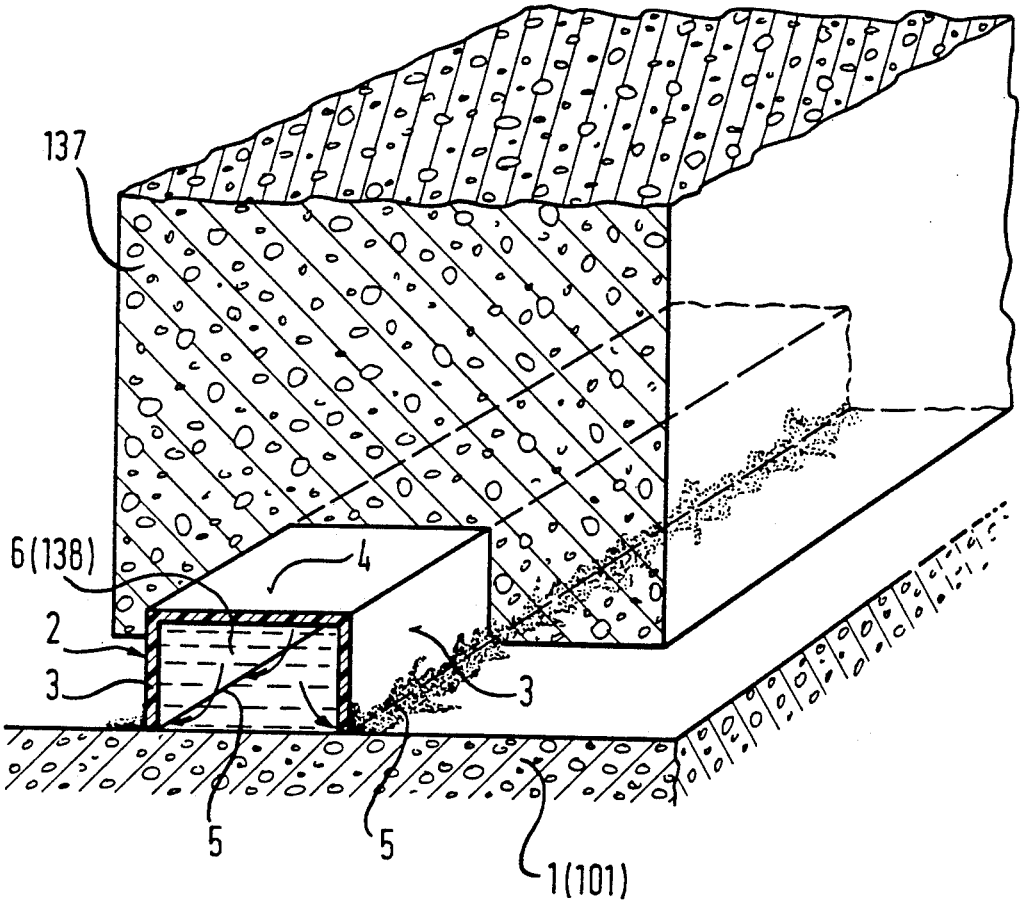
FIG. 23 shows a perspective view of a cross section similar to FIG. 22, showing the profile of FIG. 1 filled with the sealing medium and disposed between two concrete sections.

For a better understanding of the present invention, FIG. 23 shows the profile 2 mounted on the concrete surface 1 or 101 in the joint area between the concrete surface 1 or 101 and the concrete wall 137 which is formed in the manner indicated above. The sealing medium, which has been introduced into the flow channel 6 or 138 in the manner set forth above, is shown to have forced its way to the outside between the longitudinal edges 5 of the profile 2 and the concrete surface 1 or 101 to seal off the untight areas or the receptive areas for the sealing medium, as mentioned above.

Finally, also for a better understanding of the present invention, FIG. 24 shows the body 102 mounted on the concrete surface 1 or 101 in the joint area between the concrete surface 1 or 101 and the concrete wall 137 which is formed in the manner indicated above. As mentioned above, the sealing medium, by reason of the porous property of the body 102, can pass through the passage pores of the latter and can emerge into the joint area. As shown, the sealing medium emerges in the space between the concrete surface 1 or 101 and the underside 105 of the body 102, as well as from its upper side 104 and its side surfaces 103 into the joint area.

| LIST OF REFERENCE NUMBERS | |
|---|---|
| 1 | Concrete surface |
| 2 | Profile |
| 3 | Side wall |
| 4 | Cover wall |
| 5 | Longitudinal edge |
| 6 | Flow channel |
| 6a | Passage channel |
| 7 | Screw |
| 8 | Screw head |
| 9 | Sealing lip |
| 10 | Synthetic (plastic) foam |
| 10a | Clearance |
| 11 | Bottom wall |
| 12 | Profile |
| 13 | Longitudinal slit |
| 14 | Connecting piece |
| 15 | Flat corner angle |
| 16 | Upright corner angle |
| 17 | T-piece |
| 18 | Crossing piece |
| 19 | Abutting edge |
| 20 | Side wall |
| 21 | (Flexible) tube |
| 22 | Profile |
| 23 | Press-in connector |
| 24 | Hole |
| 25 | Notch |
| 26 | Notch apex |
| 27 | Side edge |
| 31 | Strap |
| 32 | Support part |
| 33 | Holding arm |
| 34 | Supporting arm |
| 35 | Reinforcing rod |
| 36/37 | Wrapping point |
| 38 | End part |
| 42/52 | Profile |

-continued

| LIST OF REFERENCE NUMBERS | |
|---|---|
| 43/53 | Side wall |
| 44/54 | Cover wall |
| 46 | Flange |
| 47 | Foam material band |
| 62 | Profile |
| 101 | Concrete surface |
| 102 | Body |
| 103 | Side surface |
| 104 | Upper side |
| 105 | Underside |
| 106 | Passage channel |
| 107 | Screw |
| 108 | Screw head |
| 109 | Support profile |
| 110 | Spacer |
| 114 | Connecting piece |
| 115 | Flat corner angle |
| 116 | Upright corner angle |
| 117 | T-piece |
| 118 | Crossing piece |
| 121 | (Flexible) tube |
| 123 | Press-in connector body |
| 124 | Hole |
| 125 | Notch |
| 126 | Notch apex |
| 127 | Notch edge surface |
| 131 | Ground water relief connector |
| 132 | Bottom plate |
| 133 | Ground water level |
| 134/135 | Pipe |
| 136 | Connecting place |
| 137 | Concrete wall |
| 138 | Sealing device |
| 139 | Bore |
| 140 | Adhesive band |
| 141 | Rubber band |

What is claimed is:

1. A sealing device for sealing a joint disposed between two concrete sections, comprising:

sealing means for filling the joint, said sealing means including a sealing medium;

a body for providing a flow path for said sealing medium;

securement means for mounting said body on one of the concrete sections in an area of the joint;

said body consisting of foam means for receiving an injection of said sealing medium, for passage of said sealing medium through said body, and for permitting said sealing medium to emerge from said body into the joint; and said foam means having open passage pores for conducting said sealing medium into said body, through said body, and out of said body in a flow arrangement.

2. A sealing device according to claim 1, wherein said foam means is a plastic foam material.

3. A sealing device according to claim 1, wherein said foam means is a synthetic foam band.

4. A sealing device according to claim 1, wherein said body is substantially rectangular in a cross section thereof.

5. A sealing device according to claim 1, wherein said securement means includes one or more screws, pins or nails gripping through said body in an oblique direction to a longitudinal axis of said body to fasten said body.

6. A sealing device according to claim 5, wherein tubular spacers are disposed in said body for receiving a shaft of associated ones of said screws, pins or nails, each tubular spacer having a length corresponding to a cross section height of said body.

7. A sealing device according to claim 5, wherein a head of each of said screws or nails is supported on an upper portion of said body, and a shaft of each of said screws or nails extends through said body.

8. A sealing device according to claim 1, wherein said securement means includes one or more support profiles surrounding a transverse portion of said body on top and side surfaces thereof to fasten said body.

9. A sealing device according to claim 1, wherein in addition to said open passage pores, recess means are provided within said body for passage of said sealing medium through said body, said recess means including a continuous flow channel extending longitudinally through said body.

10. A sealing device according to claim 1, wherein notch means are provided in said body to permit said body to be transversely bent along a longitudinal axis of said body for mounting on a curved concrete surface.

11. A sealing device according to claim 10, wherein said notch means are longitudinally spaced-part V-shaped notches extending transversely through said body from opposing sides of said body, a notch apex of each of said V-shaped notches being disposed below an upper portion of said body.

12. A sealing device according to claim 10, wherein side surfaces of each of said V-shaped notches abut against each other to close each of said V-shaped notches when said body is disposed on a curved concrete surface.

13. A sealing device according to claim 1, wherein connecting elements join said body to other bodies of the same construction, one of said connecting elements being disposed at abutting edges of adjacent bodies, each of said connecting elements having a similar cross section as said bodies, said connecting elements being fabricated from a synthetic material.

14. A sealing device according to claim 13, wherein said connecting elements include any one of straight connecting pieces, flat corner angles, upright corner angles, T-shaped pieces and crossing pieces.

15. A sealing device according to claim 13, including adhesive band means for securing said connecting elements and said bodies together at abutting places therebetween.

16. A sealing device according to claim 13, wherein nonporous tube means are connected to at least one of said bodies and connecting elements for injecting said sealing medium into the joint area, a free end of said nonporous tube means being outside the joint area.

17. A sealing device according to claim 13, wherein notch means are provided in said bodies and said connecting elements to permit said bodies and connecting elements to be transversely bent along a longitudinal axis thereof for mounting on a curved concrete surface.

18. A sealing device according to claim 17, including band means for holding said bodies and said connecting elements on a circular element, said band means being an endless rubber band disposed around a curved outer side of said bodies and said connecting elements.

19. A sealing device according to claim 17, wherein said bodies and said connecting elements are disposed in a circular configuration around a ground water relief connector for sealment thereof.

20. A sealing device according to claim 17, wherein said bodies and said connecting elements are disposed in a circular configuration around a connecting place disposed between two pipes for sealment thereof.

* * * * *